US010167744B2

(12) United States Patent
Okamoto

(10) Patent No.: US 10,167,744 B2
(45) Date of Patent: Jan. 1, 2019

(54) VALVE GEAR FOR ENGINE

(71) Applicant: YAMAHA HATSUDOKI KABUSHIKI KAISHA, Iwata-shi, Shizuoka (JP)

(72) Inventor: Yasuo Okamoto, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 167 days.

(21) Appl. No.: 15/516,047

(22) PCT Filed: Oct. 2, 2015

(86) PCT No.: PCT/JP2015/078055

§ 371 (c)(1),
(2) Date: Mar. 31, 2017

(87) PCT Pub. No.: WO2016/052731

PCT Pub. Date: Apr. 7, 2016

(65) Prior Publication Data

US 2017/0298784 A1 Oct. 19, 2017

(30) Foreign Application Priority Data

Oct. 3, 2014 (JP) ..... 2014-205096

(51) Int. Cl.
*F01L 1/34* (2006.01)
*F01L 1/18* (2006.01)
(Continued)

(52) U.S. Cl.
CPC ..... *F01L 1/18* (2013.01); *F01L 1/053* (2013.01); *F01L 1/267* (2013.01); *F01L 13/00* (2013.01);
(Continued)

(58) Field of Classification Search
CPC ... F01L 1/18; F01L 1/267; F01L 1/053; F01L 13/00; F01L 2001/186; F01L 2001/0476
See application file for complete search history.

(56) References Cited

U.S. PATENT DOCUMENTS 4,887,563 A * 12/1989 Ishida ..... F01L 1/267 123/90.16
5,680,835 A 10/1997 Ruffing et al.
(Continued)

FOREIGN PATENT DOCUMENTS

JP 01-315606 A 12/1989
JP 08-6569 B2 1/1996
(Continued)

OTHER PUBLICATIONS

Official Communication issued in International Patent Application No. PCT/JP2015/078055, dated Dec. 22, 2015.

*Primary Examiner* — Zelalem Eshete
(74) *Attorney, Agent, or Firm* — Keating and Bennett, LLP

(57) ABSTRACT

A valve gear for an engine includes camshaft supports, a camshaft, a rocker housing separate from the cam shaft supports, a rocker shaft, a first rocker arm, and a second rocker arm selectively connected to the first rocker arm by switch pins. The valve gear includes a second switch pin and a hydraulic piston that presses the switch pins, and first and second hydraulic supplies that apply an oil pressure to the pistons. The second switch pin is provided in a second rocker arm, and the hydraulic piston is provided in the rocker housing. The first hydraulic supply includes a first oil passage in the second rocker arm, the rocker shaft, and the rocker housing. The second hydraulic supply includes a second oil hole in the rocker housing.

4 Claims, 13 Drawing Sheets

(51) Int. Cl.

| | |
|---|---|
| ***F01L 13/00*** | (2006.01) |
| ***F01L 1/053*** | (2006.01) |
| ***F01L 1/26*** | (2006.01) |
| *F01L 1/047* | (2006.01) |

(52) U.S. Cl.
CPC . *F01L 2001/0476* (2013.01); *F01L 2001/186* (2013.01)

(56) References Cited

U.S. PATENT DOCUMENTS

| | | | |
|---|---|---|---|
| 2008/0141964 | A1 | 6/2008 | Ha et al. |
| 2008/0308082 | A1 | 12/2008 | Kisaichi et al. |
| 2009/0151676 | A1 | 6/2009 | Kim et al. |
| 2014/0137823 | A1 | 5/2014 | Sugiura et al. |

FOREIGN PATENT DOCUMENTS

| | | | |
|---|---|---|---|
| JP | 08-226310 | A | 9/1996 |
| JP | 10-18826 | A | 1/1998 |
| JP | 2014-101814 | A | 6/2014 |
| JP | 2015-094238 | A | 5/2015 |

* cited by examiner

VALVE GEAR FOR ENGINE

BACKGROUND OF THE INVENTION

1. Field of the Invention

The present invention relates to a valve gear for an engine that switches between an operation in which two types of rocker arms are connected to each other and an operation in which the rocker arms are disconnected.

2. Description of the Related Art

A conventional type of valve gear for an engine is described in, for example, Japanese Patent Publication No. 8-6569. The valve gear disclosed in Japanese Patent Publication No. 8-6569 converts the rotation of a camshaft into a reciprocating motion using rocker arms, and drives two intake or exhaust valves.

The camshaft includes a high-speed cam and two low-speed cams located on two sides of the high-speed cam. The high-speed cam has a shape that relatively increases a valve lift amount more than that of the low-speed cams.

The rocker arm includes two main arms of the respective intake or exhaust valves, and a sub arm located between the main arms.

Each main arm includes a slipper which the low-speed cam of the camshaft contacts, and is swingably supported by a rocker shaft. The main arm is biased against the low-speed cam by the valve spring of the corresponding intake or exhaust valve.

The sub arm includes a slipper which the high-speed cam of the cam shaft contacts, and is swingably supported by the rocker shaft. The sub arm is biased against the high-speed cam by a dedicated return spring. These main arms and sub arm are integrated by being connected to each other by a hydraulic switch, and are disconnected and separated.

The switch includes a switch pin movably provided in the pin hole of the sub arm, plungers respectively movably provided in the plunger holes of the two main arms, a hydraulic circuit that applies an oil pressure to the plungers, and the like. The switch pin and the two plungers are located on the same axis when the intake or exhaust values are closed.

The hydraulic circuit includes an oil passage for each plunger, which is provided in the rocker shaft, and a communicating passage for each main arm, which communicates the oil passage with the interior of the plunger hole. The oil passages in the rocker shaft are arranged in the axial direction of the rocker shaft, and are partitioned by partitions in the rocker shaft.

The main arms and sub arm are integrated when one of the plungers presses the switch pin and the other plunger. In this case, one plunger is fitted in the pin hole of the sub arm and located across one main arm and the sub arm. The switch pin is fitted in the plunger hole of the other main arm and located across the sub arm and the other main arm. When the main arms and the sub arm are in a connected state, the main arms operate together with the sub arm pressed by the high-speed cam, thus driving the intake or exhaust valves.

To separate the main arms and the sub arm, the switch pin is pressed back by the other plunger to a state in which one plunger is located in only the main arm and the switch pin is located in only the sub arm. When a non-connected state is set by separating the sub arm and the main arms, the sub arm pressed by the high-speed cam solely swings, and the main arms pressed by the low-speed cams drive the intake or exhaust valves.

The valve gear disclosed in Japanese Patent Publication No. 8-6569 has a problem in that oil passages that supply lubricating oil to connectors between the rocker shaft and the main arms and sub arm cannot be provided. A reason for this is that oil passages that apply an oil pressure to the plungers occupy the interior of the rocker shaft. This problem can be solved by providing the oil passages that apply the oil pressure and the lubricating oil passages in the radial direction of the rocker shaft. If, however, this arrangement is used, the outer diameter of the rocker shaft becomes large, thus increasing the size of the rocker arm. Thus, such arrangement cannot be used.

SUMMARY OF THE INVENTION

Preferred embodiments of the present invention provide a valve gear for an engine including a plurality of camshaft supports provided in a cylinder head aligned in an axial direction of a crankshaft, a camshaft rotatably supported by the plurality of camshaft supports, and including a cam that drives one of an intake valve and an exhaust valve, a rocker housing separate from the cam shaft supports and mounted on the cylinder head to be located between the camshaft supports, a rocker shaft including first and second ends supported by the rocker housing, a first rocker arm swingably supported by the rocker shaft, a second rocker arm swingably supported by the rocker shaft and selectively connected to the first rocker arm by a switch pin movable in an axial direction of the rocker shaft, a first piston that moves the switch pin to a first side in the axial direction, a second piston that moves the switch pin to a second side in the axial direction, and hydraulic supplies that apply an oil pressure to the first piston and the second piston, wherein one piston of the first and second pistons is provided in one rocker arm of the first and second rocker arms, the other piston of the first and second pistons is provided in the rocker housing located on a side opposite to the one piston in the axial direction across the other rocker arm of the first and second rocker arms, the hydraulic supply that applies the oil pressure to the one piston includes a first oil passage in the one rocker arm, the rocker shaft, and the rocker housing that supports the first end of the rocker shaft, and the hydraulic supply that applies the oil pressure to the other piston includes a second oil passage in the rocker housing.

According to a preferred embodiment of the present invention, an oil pressure applied to one of the two pistons is supplied through the first oil passage including the interior of the rocker shaft. An oil pressure applied to the other piston is supplied through the second oil passage provided in a rocker housing.

The first oil passage is preferably a path from one rocker arm through one end of the rocker shaft to the rocker housing. Thus, a lubricating oil passage is located in a portion except for the first end of the rocker shaft.

Therefore, according to a preferred embodiment of the present invention, it is possible to provide a valve gear for an engine in which a lubricating oil passage is provided in a rocker shaft without increasing the outer diameter of the rocker shaft while using an oil passage in the rocker shaft to apply the oil pressure.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

First Preferred Embodiment

A first preferred embodiment of the present invention provides a valve gear for an engine as will be described in detail below with reference to FIGS. 1 to 14.

Figure 1:
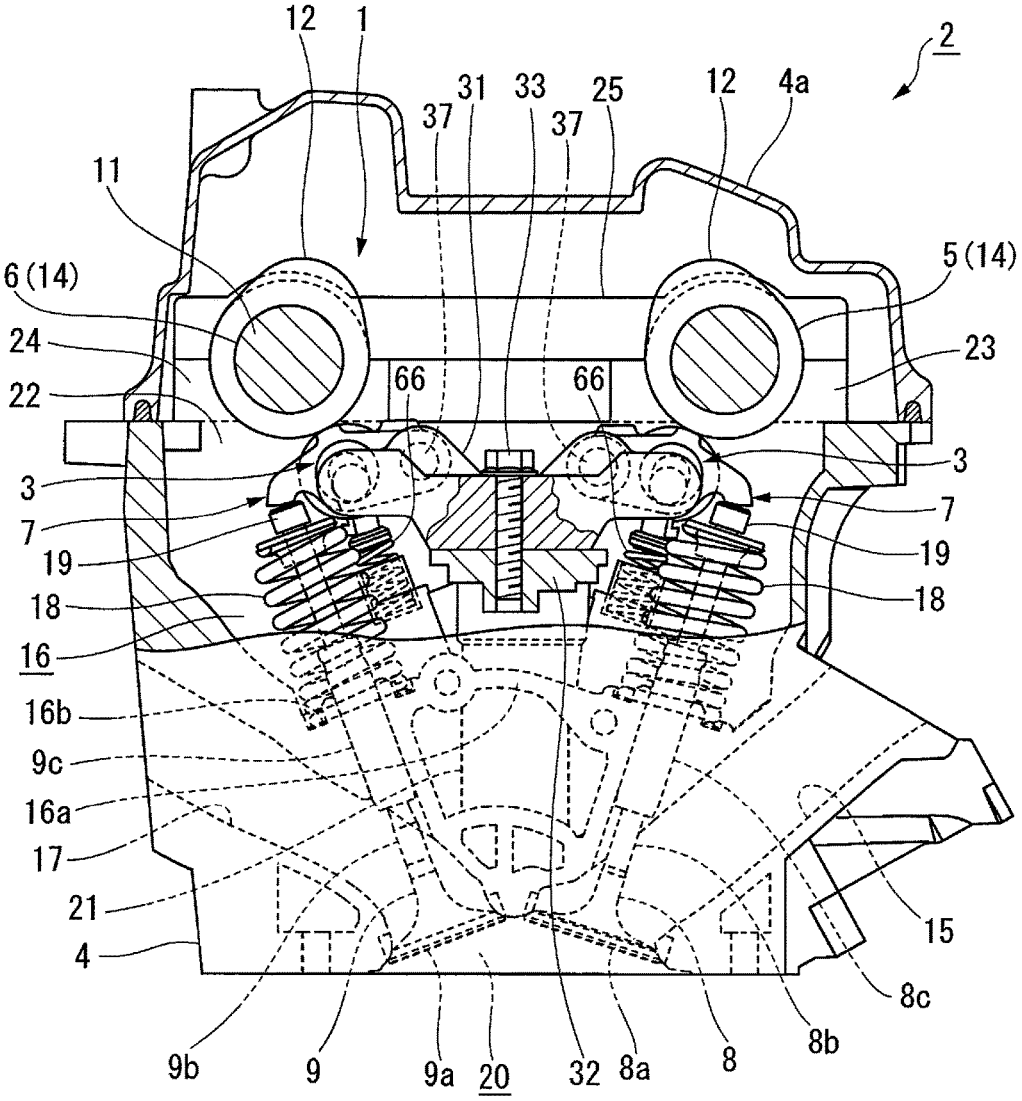
FIG. 1 is a side view showing a valve gear according to a preferred embodiment of the present invention, and shows a state in which a cylinder head and a rocker housing are partially cut away.

A valve gear 1 shown in FIG. 1 is mounted on, for example, a DOHC four-cylinder engine 2 included in a vehicle.

Figure 2:
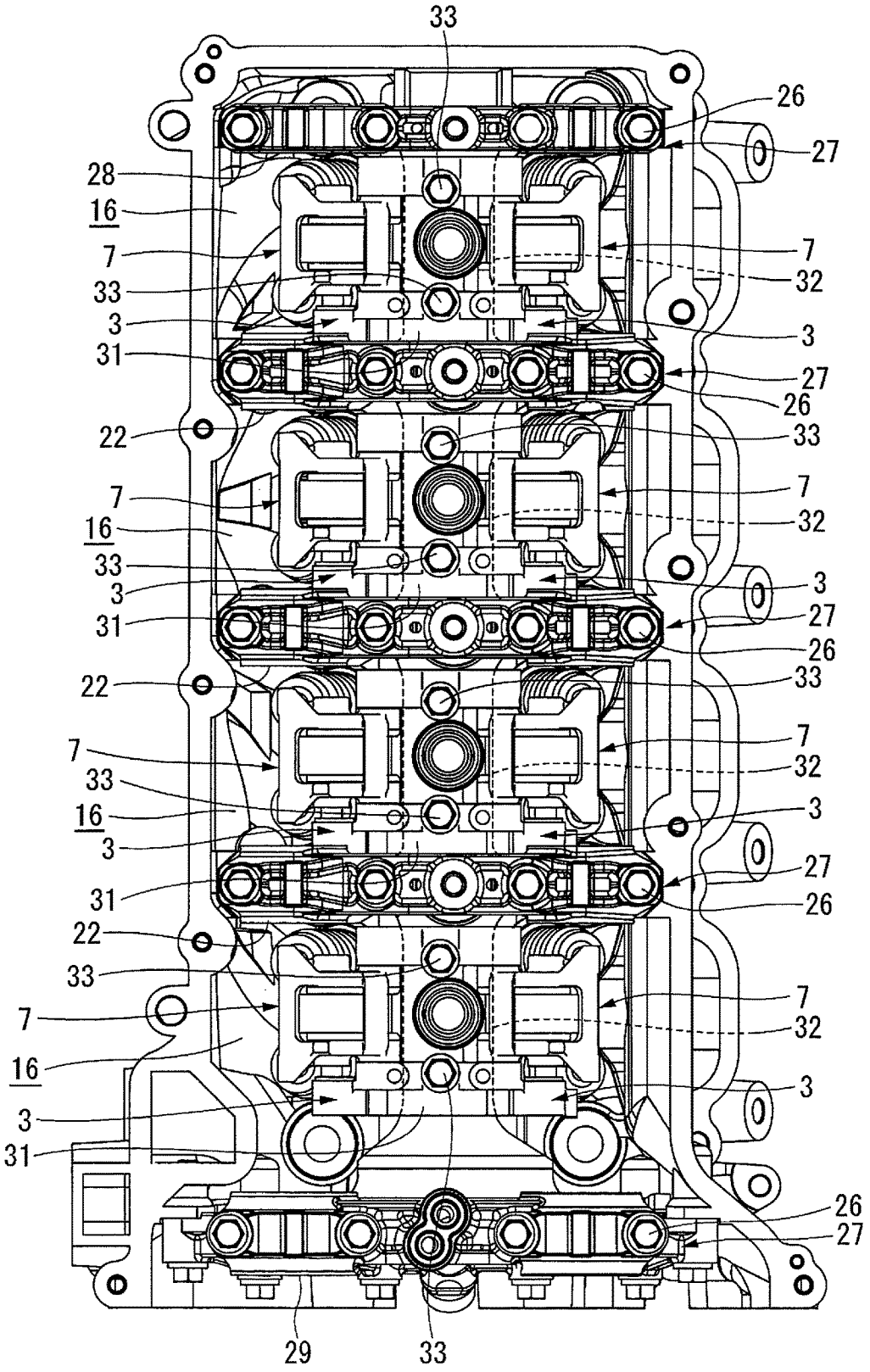
FIG. 2 is a plan view showing the cylinder head, and shows a state in which an intake camshaft and an exhaust camshaft are detached.

The valve gear 1 includes switches 3 (see FIG. 2) to switch among a plurality of operations (to be described later). The switches 3 switch between an operation in which cylinders are operated as usual and an operation in which the cylinders are at rest, as will be described later in detail. The switches 3 shown in FIG. 2 are provided on the intake valve side (the right side in FIG. 2) and the exhaust valve side (the left side in FIG. 2) of all the cylinders.

The operations selected by the switches 3 include a full cylinder operation in which the four cylinders are operated as usual and a partial cylinder operation in which only an arbitrary cylinder among the four cylinders is operated. FIG. 2 shows a state in which the switches 3 are provided in all the cylinders so as to change the number of cylinders operated when the partial cylinder operation is used. When the partial cylinder operation is used, if only one of the four cylinders is operated, one-cylinder operation is set. If only two of the four cylinders are operated, a ½ reduced cylinder operation is set. If only three of the four cylinders are operated, a three-cylinder operation is set. If the four cylinders are at rest, a full cylinder rest is set.

If the one- or three-cylinder operation is used, an arrangement is used in which a cylinder to be operated is determined and selected based on a predetermined rule and all the cylinders are equally operated.

The ½ reduced cylinder operation is able to be implemented in the first and second operations in which different cylinders are operated. In the first operation, a cylinder (first cylinder) located at one end in a direction in which the four cylinders are arranged, and the fourth cylinder from the one end are operated. In the second operation, the second and third cylinders from one end in the direction in which the four cylinders are arranged are operated.

If only the ½ reduced cylinder operation and the full cylinder operation are selected, the switches 3 are generally mounted on only the cylinders which are at rest. If the switches 3 are provided in all the cylinders, it is possible to alternately switch, based on the predetermined rule, between the ½ reduced cylinder operation using the first operation and the second operation. For example, since all the cylinders are almost equally operated by frequent switching between the first operation and the second operation, the temperature distribution of the engine is uniform or substantially uniform although the ½ reduced cylinder operation is used.

The full cylinder rest operation is selected when, for example, an accelerator is turned off. If the full cylinder rest operation is used, only adiabatic compression and adiabatic expansion are repeated in each cylinder, and there is no intake or exhaust to or from a combustion chamber, thus decreasing a pumping loss.

As shown in FIG. 1, the valve gear 1 includes the switches 3 according to the present preferred embodiment. The valve gear 1 converts the rotations of an intake camshaft 5 and an exhaust camshaft 6, both of which are provided in a cylinder head 4, into reciprocating motions using rocker arms 7 in the cylinder operated as usual, thus driving an intake valve 8 and an exhaust valve 9.

A portion which drives the intake valve 8 and a portion which drives the exhaust valve 9 in the valve gear 1 preferably have the same structure. For this reason, as for elements which have the same structure on the side of the intake valve 8 and on the side of the exhaust valve 9, the element on the side of the exhaust valve 9 will be described. The element on the side of the intake valve 8 is denoted by the same reference number and a description thereof will be omitted.

Each of the intake camshaft 5 and the exhaust camshaft 6 includes a camshaft main body 11 rotatably supported in the cylinder head 4, and a cam 12 provided on the camshaft main body 11. Note that the intake camshaft 5 and the exhaust camshaft 6 will generally simply be referred to as camshafts 14 hereinafter.

The camshaft main body 11 preferably has a rod shape with a circular or substantially circular section, for example.

Figure 3:
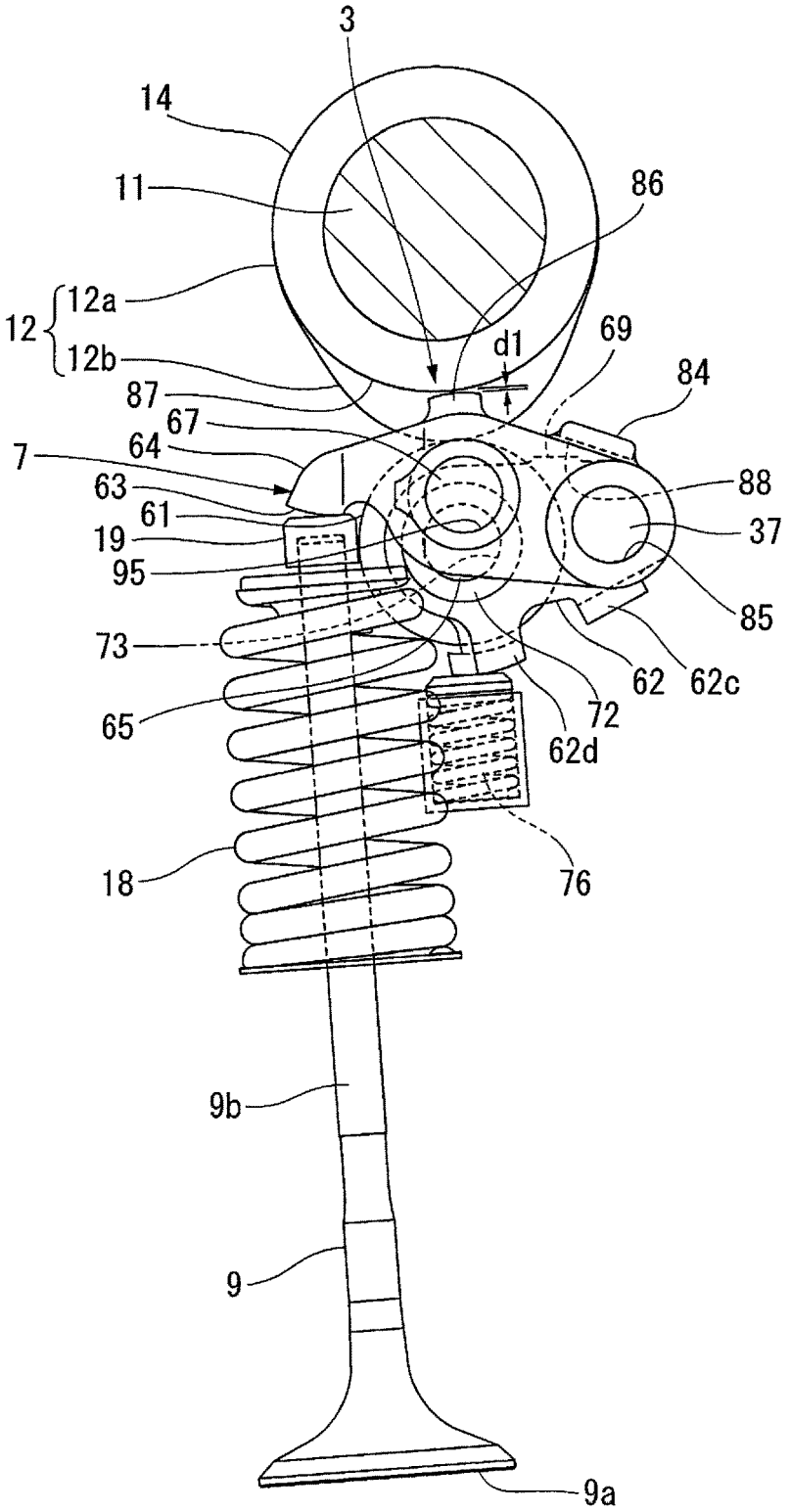
FIG. 3 is a side view for explaining a non-connected state (cylinder rest state).

As shown in FIG. 3, the cam 12 includes a circular or substantially circular base 12*a* and a nose 12*b*. The circular base 12*a* preferably has a shape of a column located on the same axis as the camshaft main body 11, and a size that brings the valve lift amount of the intake valve 8 or the exhaust valve 9 to zero or substantially zero. The nose 12*b* preferably has a shape that projects outward in the radial direction from the circular base 12*a* by a predetermined projection amount so as to have a mountain-shaped section.

The intake valve 8 and the exhaust valve 9 each preferably include two valves per cylinder, and each valve is reciprocally supported by the cylinder head 4. The two intake valves 8 are arranged at a predetermined interval in the axial direction of the intake camshaft 5. The two exhaust valves 9 are arranged at a predetermined interval in the axial direction of the exhaust camshaft 6.

As shown in FIG. 1, the intake valve 8 includes a valve body 8*a* which opens/closes an intake port 15 of the cylinder head 4, and a valve shaft 8*b* extending from the valve body 8*a* into a valve chamber 16 of the cylinder head 4. The exhaust valve 9 includes a valve body 9*a* which opens/closes an exhaust port 17 of the cylinder head 4, and a valve shaft 9*b* extending from the valve body 9*a* into the valve chamber 16 of the cylinder head 4. The valve shafts 8*b* and 9*b* are respectively supported via valve shaft guides 8*c* and 9*c* press-fitted in a valve chamber bottom wall 16*a* of the cylinder head 4. A valve spring 18 which biases the intake valve 8 or the exhaust valve 9 in a direction to close the valve is provided between the distal end of each of the valve shafts 8*b* and 9*b* and a bottom surface 16*b* of the valve chamber bottom wall 16*a*. A cap-shaped shim 19 is provided at the distal end of each of the valve shafts 8*b* and 9*b*.

The upstream end of the intake port 15 is open to one side of the cylinder head 4. The downstream end of the intake port 15 is open to a combustion chamber 20 of each cylinder. The upstream end of the exhaust port 17 is open to the combustion chamber 20. The downstream end of the exhaust port 17 is open to the other side of the cylinder head 4. A tubular wall 21 that attaches and detaches a spark plug from above is provided in a portion corresponding to the center of the combustion chamber 20 in the cylinder head 4.

The valve chamber 16 of the cylinder head 4 is surrounded by the cylinder head 4 and a cylinder head cover 4*a* (see FIG. 1) mounted on the cylinder head 4, and is partitioned for each cylinder by partitions 22 (see FIG. 2) located between the cylinders. As shown in FIG. 1, an intake-side journal 23 that supports the intake camshaft 5 and an exhaust-side journal 24 that supports the exhaust camshaft 6 are located in the upper end portion of each partition 22. A cam cap 25 is mounted on the journals 23 and 24 by a plurality of mounting bolts 26, for example (see FIG. 2).

The cam cap 25 rotatably supports the intake camshaft 5 and the exhaust camshaft 6 by sandwiching them with the journals 23 and 24. A camshaft support 27 including the journals 23 and 24 and the cam cap 25 is provided in each of the above-described partitions 22 between the cylinders and partitions 28 and 29 at the front end and rear end of the cylinder head 4. The front end and rear end respectively correspond to an upper end and a lower end in FIG. 2, and correspond to one end and the other end in the axial direction of the crankshaft of the engine 2.

Rocker housings 31 that support the rocker arms 7 (to be described later) are provided between the camshaft supports 27 in the cylinder head 4. The rocker housing 31 according to the present preferred embodiment is provided for each cylinder, and is fixed, by fixing bolts 33, for example, to a support wall 32 (see FIG. 1) that is integral with the cylinder head 4 across the partitions 22. As shown in FIG. 1, the support wall 32 extends in the axial direction of the crankshaft by intersecting the tubular wall 21 that attaches and detaches the spark plug. The upper end of the tubular wall 21 is connected to the support wall 32, and a circular or substantially circular opening connected to the interior of the tubular wall 21 is provided in the support wall 32. All of the above-described valve chamber bottom walls 16*a*, tubular walls 21, partitions 22, and support walls 32 define a portion of the cylinder head 4, and are preferably integrally molded at the time of casting of the cylinder head 4.

Figure 4:
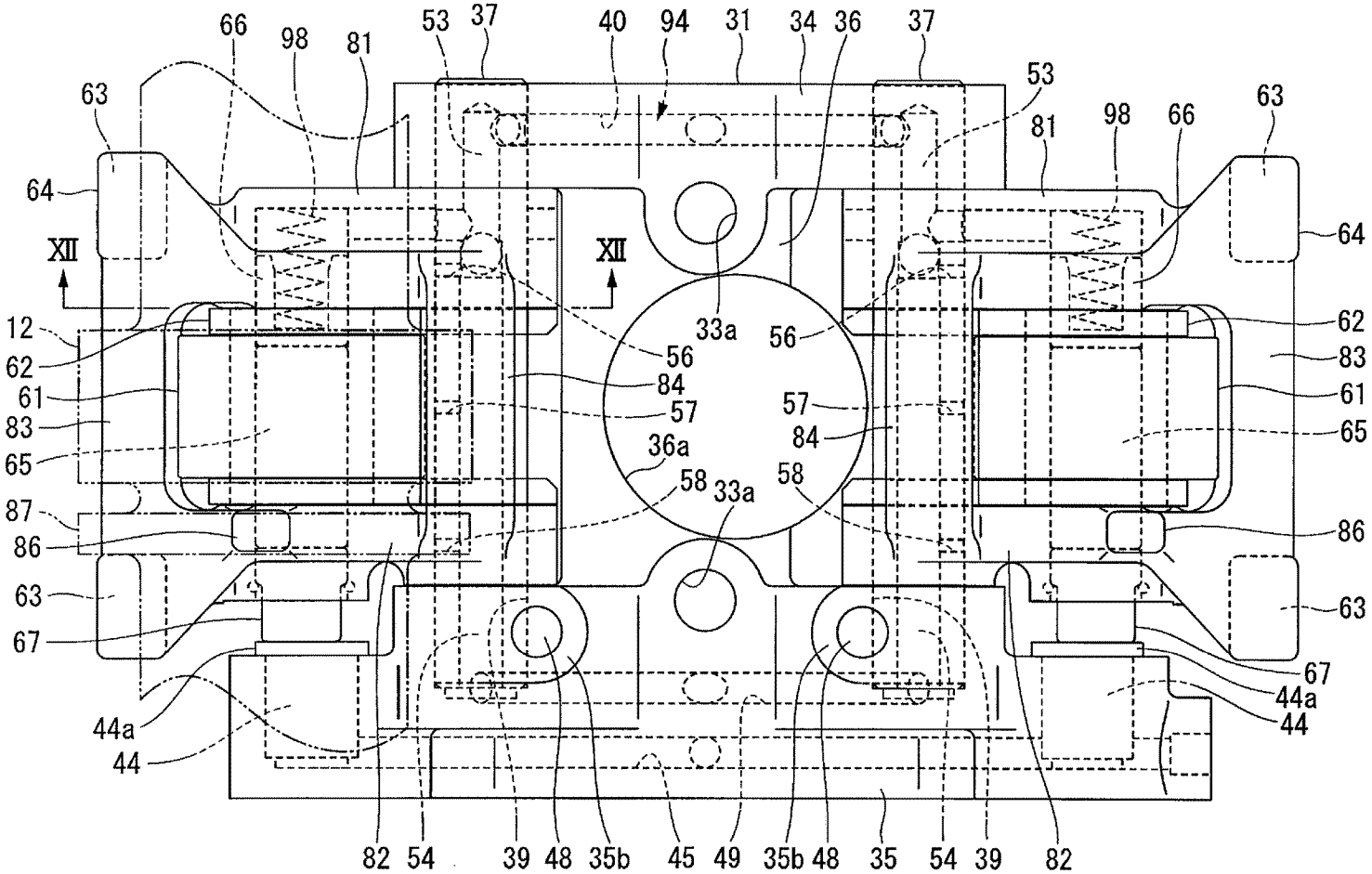
FIG. 4 is a plan view showing the valve gear.
Figure 5:
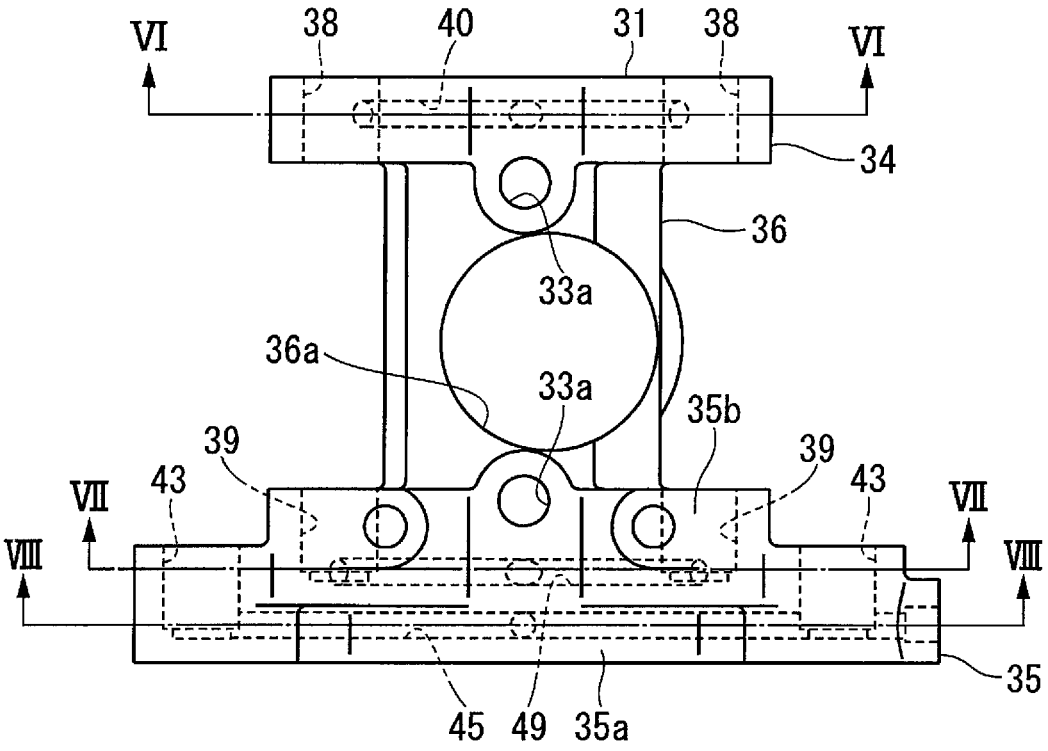
FIG. 5 is a plan view showing the rocker housing.

As shown in FIGS. 4 and 5, the rocker housing 31 includes three functional elements. These functional elements include a first rocker shaft support 34 located uppermost in FIG. 5, a second rocker shaft support 35 located lowermost in FIG. 5, and a connector 36 which connects the first rocker shaft support 34 and the second rocker shaft support 35. The first rocker shaft support 34, the second rocker shaft support 35, and the connector 36 according to the present preferred embodiment are preferably integrally formed by casting, for example.

Two circular or substantially circular holes 38 and two circular or substantially circular holes 39 in which rocker shafts 37 (see FIG. 4) are fitted are provided in the first rocker shaft support 34 and the second rocker shaft support 35, respectively. In addition, through holes 33*a* (see FIG. 5) are provided for the fixing bolts 33. The rocker shaft 37 which supports the rocker arm 7 that drives the intake valve is fitted in one of the two circular holes 38 and one of the two circular holes 39. The rocker shaft 37 which supports the rocker arm 7 that drives the exhaust valve is inserted in the other one of the circular holes 38 and the other one of the circular holes 39.

Figure 6:
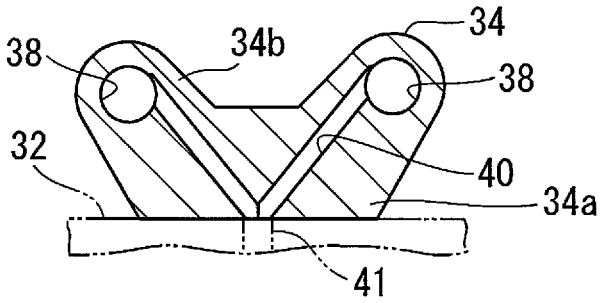
FIG. 6 is a sectional view taken along a line VI-VI in FIG. 5.

As shown in FIG. 6, the first rocker shaft support 34 includes a base 34*a* mounted on the support wall 32 and convex portions 34*b* projecting upward from the base 34*a*. The two circular holes 38 in which first ends of the rocker shafts 37 are fitted are provided in the convex portions 34*b*.

The two circular holes 38 of the first rocker shaft support 34 are non-through holes. The first ends of the rocker shafts 37 are respectively fitted in the circular holes 38. A first oil hole 40 is connected to the circular holes 38. As shown in FIG. 6, the first oil hole 40 preferably has a V shape when viewed from the axial direction of the rocker shaft 37 to lead oil from a first oil inlet and outlet 41 of the cylinder head 4 into the two circular holes 38. The circular holes 38 and the first oil hole 40 define a portion of a first hydraulic supply 42 (to be described later) (see FIG. 9). The first hydraulic supply 42 corresponds to a "hydraulic supply that applies an oil pressure to one piston."

The first oil inlet and outlet 41 is provided in the support wall 32 of the cylinder head 4.

Figure 7:
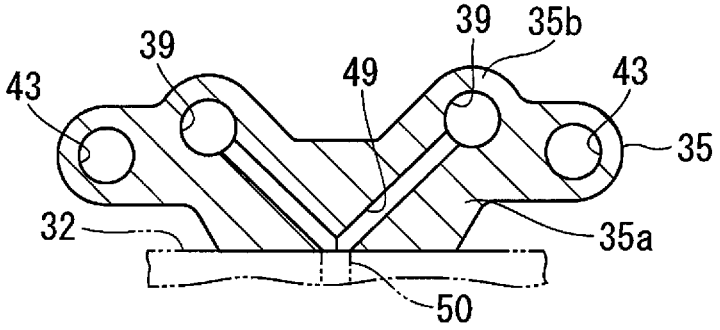
FIG. 7 is a sectional view taken along a line VII-VII in FIG. 5
Figure 8:
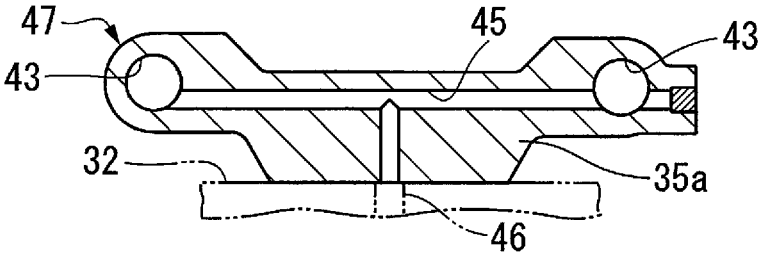
FIG. 8 is a sectional view taken along a line VIII-VIII in FIG. 5.

As shown in FIGS. 7 and 8, the second rocker shaft support 35 includes a hydraulic operator 35*a* mounted on the support wall 32 and convex portions 35*b* projecting upward from the hydraulic operation portion 35*a*.

The hydraulic operator 35*a* projects toward two sides from the convex portions 35*b*. Cylinder holes 43 are respectively provided in two end portions of the hydraulic operator 35*a*. The cylinder holes 43 defined by non-through holes extend parallel or substantially parallel to the axis of the camshaft 14, and are open to one side where the first rocker shaft support 34 is located. Hydraulic pistons 44 (see FIG. 9) defining a portion of the above-described switch 3 are movably fitted in the cylinder holes 43, respectively. The hydraulic piston 44 corresponds to "the other piston."

As shown in FIG. 8, a second oil hole 45 is connected to the cylinder holes 43. The second oil hole 45 connects the cylinder hole 43 on the intake valve side located on one end side of the hydraulic operator 35*a* and the cylinder hole 43 on the exhaust valve side located on the other end side to a second oil inlet and outlet 46 of the cylinder head 4. The second oil inlet and outlet 46 is provided in the support wall 32. In the present preferred embodiment, the second oil hole 45 defines the "second oil passage." That is, the hydraulic piston 44 operates when supplied with an oil pressure via a second hydraulic supply 47 from the second oil hole 45 and the cylinder holes 43. The second hydraulic supply 47 corresponds to an "oil pressure supply that applies an oil pressure to the other piston."

As shown in FIG. 4, each hydraulic piston 44 includes a pressing plate 44*a* projecting from the cylinder hole 43. The pressing plate 44*a* is larger in a direction perpendicular or substantially perpendicular to the axis of the camshaft than the cylinder hole 43.

As shown in FIG. 7, the two circular holes 39 in which the other-end portions of the rocker shafts 37 are fitted are provided in the convex portions 35*b* of the second rocker shaft support 35. The circular holes 39 are non-through holes. As shown in FIG. 4, each rocker shaft 37 is engaged with a stopper pin 48 which is press-fitted in the convex portion 35*b* from above, thus implementing removal prevention and whirl-stop. A third oil hole 49 is connected to the two circular holes 39. The third oil hole 49 connects the two circular holes 39 to a lubricating oil supply 50 of the cylinder head 4. The lubricating oil supply is provided in the support wall 32.

Figure 9:
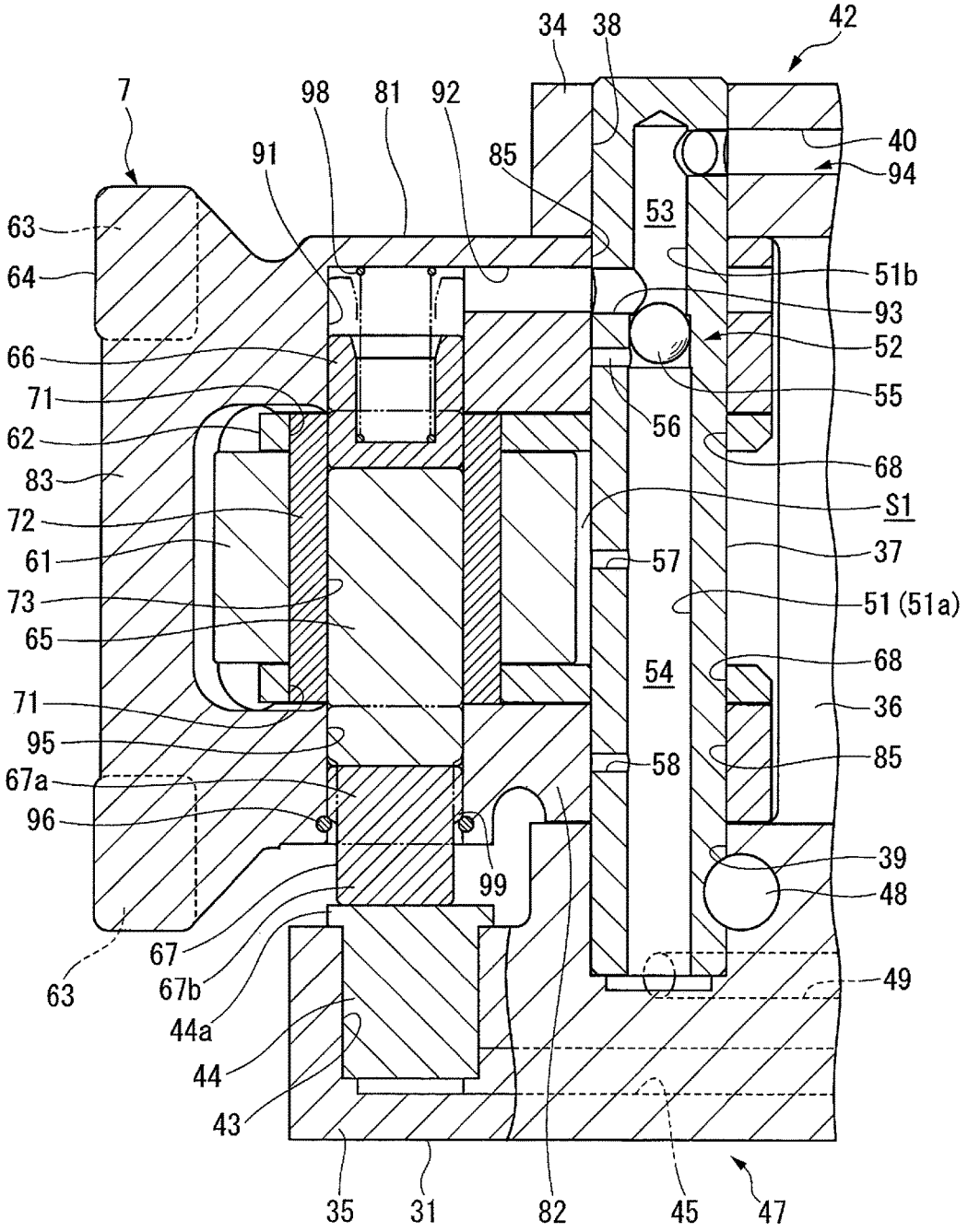
FIG. 9 is a sectional view partially showing the rocker arms and the rocker housing.

As shown in FIG. 9, an oil hole 51 defining a non-through hole which is open to one end (one end supported by the second rocker shaft support 35) of the rocker shaft 37 extends in the axial portion of the rocker shaft 37. Two oil passages 53 and 54 which are adjacent to each other in the axial direction of the rocker shaft 37 across a partition 52 are provided on the rocker shaft 37. The oil passages 53 and 54 are partitioned and include one oil hole 51 in the rocker shaft 37 and a plug 55 of the above-described partition 52. The oil hole 51 has a large-diameter portion 51*a* including an opening end and a small-diameter portion 51*b* located on the other end side with respect to the plug 55. The plug 55 closes the boundary between the large-diameter portion 51*a* and the small-diameter portion 51*b*.

Among the two oil passages 53 and 54 in the rocker shaft 37, one oil passage 53 including the small-diameter portion 51*b* is connected to the first oil hole 40 in the first rocker shaft support 34. The oil passage 53 defines a portion of the first hydraulic supply 42. The other oil passage 54 including the large-diameter portion 51*a* supplies oil to lubricated portions of the rocker arms 7 (to be described later).

First to third communication holes 56 to 58 communicating the interior of the large-diameter portion 51*a* of the oil hole 51 and the exterior of the rocker shaft 37 are provided at three positions in the middle of the rocker shaft 37. Oil sent from the above-described lubricating oil supply 50 into the circular holes 39 through the third oil hole 49 is supplied outside the rocker shaft 37 from the first to third communication holes 56 to 58 through the oil hole 51 in the rocker shaft 37.

The connector 36 of the rocker housing 31 preferably has a plate shape extending in the axial direction of the camshaft 14. As shown in FIG. 5, a circular hole 36*a* defines a through hole in the connector 36 to be concentrically connected to the circular hole (not shown) of the above-described support wall 32.

As shown in FIGS. 4 and 9, each rocker arm 7 includes a plurality of elements. The plurality of elements include a first rocker arm 62, a second rocker arm 64, and first to third switch pins 65 to 67. The first rocker arm 62 includes a roller 61 which contacts the cam 12. A valve pressing portion 63 which presses the intake valves 8 or the exhaust valves 9 is provided at the swing end of the second rocker arm 64. The first to third switch pins 65 to 67 selectively connect the first rocker arm 62 and the second rocker arm 64.

Figure 10:
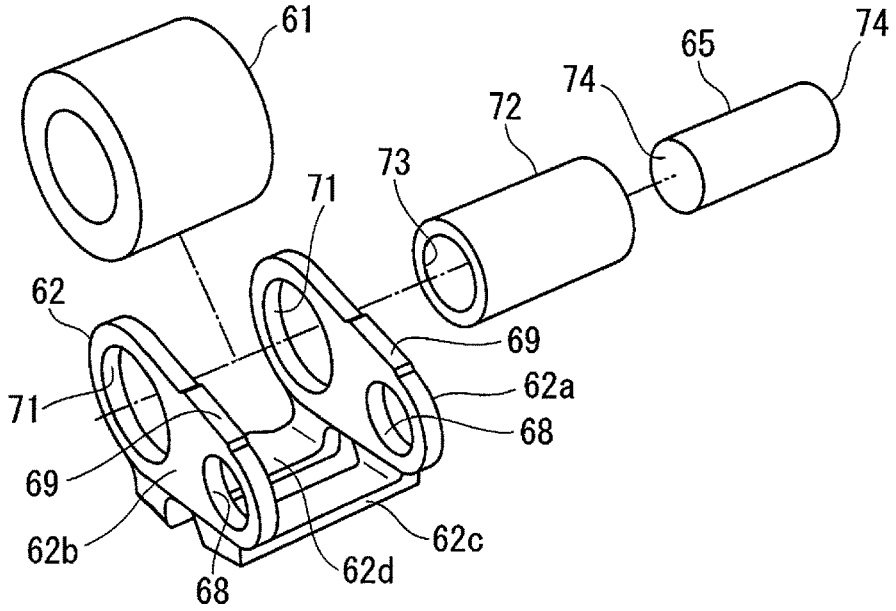
FIG. 10 is an exploded perspective view showing the first rocker arm.

As shown in FIG. 10, the first rocker arm 62 preferably has a U shape in a front view including a first arm piece 62*a* and a second arm piece 62*b* which are swingably supported by the rocker shaft 37 and two connecting pieces 62*c* and 62*d* which connect the first and second arm pieces 62*a* and 62*b*. The rocker shaft 37 is swingably fitted in through holes 68 respectively provided in the first arm piece 62*a* and the second arm piece 62*b*.

As shown in FIGS. 3 and 10, projections 69 on the first ends supported by the rocker shaft 37 of the first arm piece 62*a* and the second arm piece 62*b* are oriented toward the camshaft 14 when viewed from the axial direction of the rocker shaft 37.

The roller 61 is inserted between the first arm piece 62*a* and the second arm piece 62*b*. The roller 61 defines a cam follower which is a rotation member contacting the cam 12.

The roller 61 is rotatably supported by a support shaft 72 fitted in shaft holes 71 of the first arm piece 62*a* and the second arm piece 62*b* via a needle bearing (not shown). The axis of the support shaft 72 is parallel or substantially parallel to that of the rocker shaft 37. A portion of the outer surface of the roller 61 faces the rocker shaft 37, as shown in FIG. 9. A space S1 is provided between the roller 61 and the rocker shaft 37.

Among the above-described first to third communication holes 56 to 58, the second communication hole 57 located at the center is provided in a portion of the rocker shaft 37 facing the roller 61.

That is, some of the oil sent into the rocker shaft 37 is ejected from the second communication hole 57 located at the center and adheres to the outer surface of the roller 61, thus lubricating the contact portion between the roller 61 and the cam 12. The first and third communication holes 56 and 58 located on two sides among the three communication holes 56 to 58 are provided in portions of the rocker shaft 37, which pass through the second rocker arm 64. Therefore, the lubricated portion of the second rocker arm 64, which contacts the rocker shaft 37, is lubricated by oil flowing out from the first and third communication holes 56 and 58.

A first pin hole 73 defining a through hole is provided in the axial portion of the support shaft 72. The first switch pin 65 is fitted in the first pin hole 73 to be movable in the axial direction of the rocker shaft 37. The first switch pin 65 preferably has a columnar shape. In addition, the first switch pin 65 is longer than the width of the first rocker arm 62 (the length of the first rocker arm 62 in the axial direction of the rocker shaft 37) by a predetermined length. A convex portion 74 (see FIG. 12) projecting from the first rocker arm 62 in the first switch pin 65 is housed in a concave portion 75 of the second rocker arm 64 (to be described later).

As shown in FIG. 3, a return spring 76 is provided between the cylinder head 4 and the connecting piece 62*d* of the first rocker arm 62. The spring member 76 biases the first rocker arm 62 in a direction in which the roller 61 is pressed against the cam 12, that is, a return direction that is opposite to that in which the first rocker arm 62 is pressed by the cam 12 and swings. For this reason, when pressed by the cam 12, the first rocker arm 62 swings against the spring force of the spring member 76.

As shown in FIGS. 4 and 9, the second rocker arm 64 includes a first arm half 81 and a second arm half 82 which are swingably supported by the rocker shaft 37, and a first connector 83 and a second connector 84 which connect the arm halves 81 and 82. The first and second arm halves 81 and 82 and the first and second connectors 83 and 84 according to the present preferred embodiment are preferably integrally molded. The rocker shaft 37 is swingably fitted in through holes 85 respectively provided in the first arm half 81 and the second arm half 82.

As shown in FIG. 9, a second pin hole 91 defined by a non-through hole and an oil hole 92 extending from the pin hole 91 to the rocker shaft 37 are provided in the middle of the first arm half 81. The second pin hole 91 defines a cylinder hole. One end of the oil hole 92 is open inside the second pin hole 91, and the other end is connected to a fourth communication hole 93 of the rocker shaft 37. The fourth communication hole 93 extends in the radial direction of the rocker shaft 37 to communicate the interior of the small-diameter portion 51*b* of the oil hole 51 with the oil hole 92. That is, the second pin hole 91 communicates with the first oil inlet and outlet 41 of the cylinder head 4 via a first oil passage 94 of the oil hole 92, the fourth communication hole 93, the small-diameter portion 51*b* of the oil hole 51, and the first oil hole 40.

A third pin hole 95 defined by a through hole is provided in the middle of the second arm half 82. A circlip 96 is provided at one end (an end located on the side opposite to the first arm half 81) of the third pin hole 95.

The first arm half 81 and the second arm half 82 are disposed at positions which sandwich the first rocker arm 62 from two sides in the axial direction in a state in which the first arm half 81 and the second arm half 82 are swingably supported by the rocker shaft 37. As shown in FIGS. 3 and 4, a projection 86 is provided in a portion which is in the middle of the second arm half 82 and is oriented toward the camshaft 14. On the other hand, a disc portion 87 is provided in a portion of the camshaft 14 facing the projection 86, as indicated by two-dot dashed lines in FIG. 4. The disc portion 87 preferably has a disc shape having the same diameter as that of the circular base 12*a* of the cam 12, and is provided at a position adjacent to the cam 12.

As shown in FIG. 3, a gap d1 is provided between the disc portion 87 and the projection 86 in a state in which the valve pressing portion 63 of the second rocker arm 64 is in contact with the shim 19. When the second rocker arm 64 bounces and swings toward the camshaft 14 due to a vibration or the like, the projection 86 hits the disc portion 87 to regulate the further swing of the second rocker arm 64.

Figure 11:
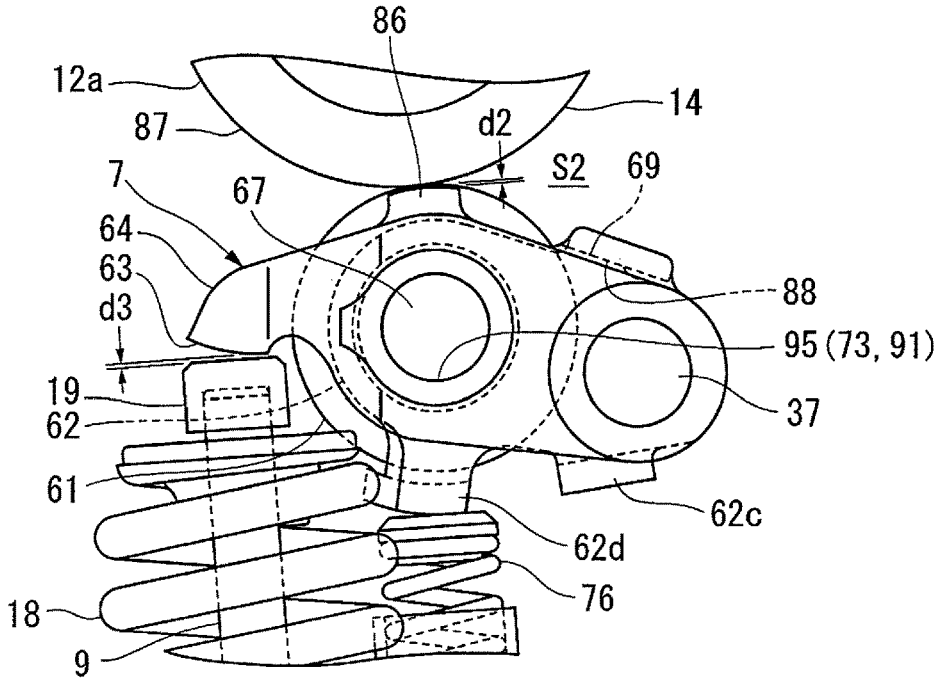
FIG. 11 is a side view for explaining a connected state while the intake or exhaust valves are closed.

As shown in FIG. 11, the projection 86 is close to the disc portion 87 of the camshaft 14 to have a slight gap d2 in a state in which the roller 61 of the first rocker arm 62 abuts against the circular base 12*a* of the cam 12. The gap d2 is narrower than the gap d1 shown in FIG. 3. In the state shown in FIG. 11, a valve clearance d3 is provided between the shim 19 and the valve pressing portion 63 of the second rocker arm 64.

The swing ends of the first arm half 81 and the second arm half 82 are connected by the first connector 83. The valve pressing portions 63 which press the shims 19 of the intake valves 8 or the exhaust valves 9 are provided at two ends of the first connector 83. That is, the second rocker arm 64 simultaneously presses the two intake valves 8 or exhaust valves 9 provided for each cylinder.

The bases of the first arm half 81 and second arm half 82, which are supported by the rocker shaft 37, are connected to each other by the second connector 84.

As shown in FIG. 3, the second connector 84 is disposed in the first ends, supported by the rocker shaft 37, of the first arm half 81 and the second arm half 82, and connects the portions facing the camshaft 14. As shown in FIG. 4, the second connector 84 crosses the first rocker arm 62 in a planar view. Therefore, when the first rocker arm 62 swings toward the cam 12 with respect to the second rocker arm 64, the projection 69 of the first rocker arm 62 moves closer to the second connector 84. In the present preferred embodiment, a stopper 88 (see FIG. 3) which abuts against the projection 69 of the first rocker arm 62 is provided on the lower surface (the surface opposite to the cam 12) of the second connector 84.

When the first rocker arm 62 swings by the spring force of the spring member 76 in a state in which the intake valves 8 or the exhaust valves 9 are closed, the projection 69 abuts against the stopper 88. After the projection 69 abuts against the stopper 88, the first rocker arm 62 and the second rocker arm 64 are integrally biased in the return direction by the spring force of the spring member 76. Thus, during this period, the first pin hole 73, a second pin hole 91, and a third pin hole 95 are aligned and maintained on the same axis. Therefore, the first to third switch pins 65 to 67 are readily and reliably switched to the connected state as shown in FIG. 9. The connected state is a state in which the first switch pin 65 moves to a position across the first pin hole 73 and the third pin hole 95, and the second switch pin 66 moves to a position across the first pin hole 73 and the second pin hole 91.

As shown in FIG. 11, the stopper 88 is located in a concave space S2 below the cam 12 at a stopper abutting position of the first rocker arm 62 where the projection 69 of the first rocker arm 62 abuts against the stopper 88. The concave space S2 indicates a space surrounded by the cam 12 of the camshaft 14, the roller 61 of the first rocker arm 62, and the rocker shaft 37 when viewed from the axial direction of the rocker shaft 37. In the following description, a state in which the projection 69 of the first rocker arm 62 abuts against the stopper 88 will simply be referred to as a "stopper abutting state" hereinafter.

Figure 12:
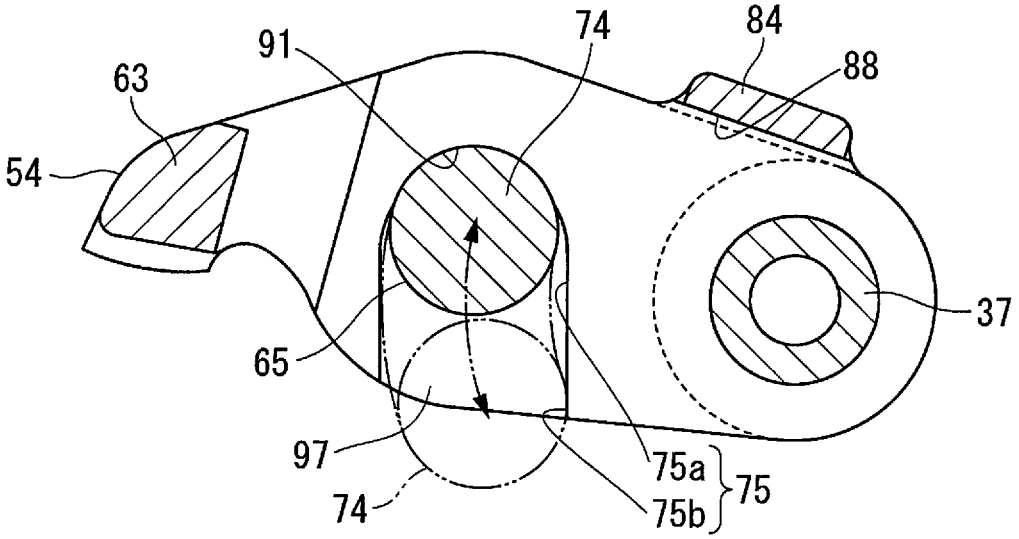
FIG. 12 is a sectional view taken along a line XII-XII in FIG. 4 and showing the second rocker arm and the first switch pin.

As shown in FIG. 12, the concave portion 75 that houses the convex portion 74 of the first switch pin 65 is provided on the inner surface of the first arm half 81 facing the first rocker arm 62. The second pin hole 91 is open inside the concave portion 75.

Although not shown, the concave portion 75 is provided on the inner surface of the second arm half 82 facing the first rocker arm 62, similarly to the first arm half 81. The third pin hole 95 is open inside the concave portion 75. The concave portion 75 of the first arm half 81 and that of the second arm half 82 preferably have the same shape at the same position when viewed from the axial direction of the rocker shaft 37.

The concave portion 75 preferably has a groove shape extending downward from the second pin hole 91 or the third pin hole 95, and includes a plurality of functional elements. In this case, "downward" indicates a direction in which the second rocker arm 64 swings when the second rocker arm 64 presses and opens the intake valves 8 or the exhaust valves 9. The plurality of functional elements include a non-regulating portion 75*a* through which the convex portions 74 at two ends of the first switch pin 65 pass when the first rocker arm 62 swings with respect to the second rocker arm 64, and a regulating portion 75*b* which regulates the movement of the convex portion 74.

In a state in which predetermined conditions are satisfied, the non-regulating portion 75*a* has a shape that allows the first rocker arm 62 to swing with respect to the second rocker arm 64 between a swing start position and a maximum swing position without regulating the passage of the convex portion 74. The state in which the predetermined conditions are satisfied indicates a state (the non-connected state to be described later) in which the first rocker arm 62 is supported by the rocker shaft 37 and is able to swing with respect to the second rocker arm 64.

The swing start position represents the position of the first rocker arm 62 while the roller 61 is in contact with the circular base 12*a* of the cam 12.

The maximum swing position represents the position of the first rocker arm 62 while a portion where the projection amount of the nose 12*b* is largest is in contact with the roller 61.

In the above-described state in which the predetermined conditions are satisfied, the regulating portion 75*b* regulates, by regulating the passage of the convex portion 74, the swing of the first rocker arm 62 beyond the maximum swing position with respect to the second rocker arm 64. That is, as indicated by two-dot dashed lines in FIG. 12, the regulating portion 75*b* intersects the moving locus of the convex portion 74 when the first rocker arm 62 swings beyond the maximum swing position.

The regulating portion 75*b* is provided in an opening 97 located on one end side of the concave portion 75 presenting the groove shape. The opening 97 is open in the lower direction (the direction opposite to the camshaft 14) of the second rocker arm 64. The regulating portion 75*b* is provided so that the opening width of the opening 97 is larger than the outer diameter of the convex portion 74. The convex portion 74 is able to enter and exit the concave portion 75 through the opening 97 in a state in which the first rocker arm 62 is not supported by the rocker shaft 37. That is, the regulating portion 75*b* allows the passage of the convex portion 74 in the state in which the first rocker arm 62 is not supported by the rocker shaft 37.

As shown in FIG. 9, the second pin hole 91 and third pin hole 95 of the second rocker arm 64 extend parallel or substantially parallel to the axis of the rocker shaft 37 across the first arm half 81 and the second arm half 82.

The distance between the axis of the rocker shaft 37 and the center line of the second pin hole 91 and the third pin hole 95 matches the distance between the axis of the rocker shaft 37 and the center line of the first pin hole 73 of the first rocker arm 62. In other words, the first pin hole 73, the second pin hole 91, and the third pin hole 95 are arranged at equidistant or substantially equidistant positions in the first rocker arm 62 and the second rocker arm 64 from the rocker shaft 37.

That is, the first pin hole 73, the second pin hole 91, and the third pin hole 95 are located on the same axis in a state in which the swing angle of the first rocker arm 62 and the swing angle of the second rocker arm 64 are predetermined angles. The predetermined angles are angles when the intake valve 8 or the exhaust valve 9 is kept closed (the valve lift amount is zero), and are angles in the above-described stopper abutting state.

The hole diameter of the second pin hole 91 and the third pin hole 95 matches the hole diameter of the first pin hole 73.

As shown in FIG. 9, the second switch pin 66 is movably fitted in the second pin hole 91. In addition, a spring member 98 that biases the second switch pin 66 toward the first rocker arm 62 is provided in the second pin hole 91. The second switch pin 66, which defines a hydraulic piston, has a closed-end cylindrical or substantially cylindrical shape, and is inserted into the second pin hole 91 in a state in which the bottom portion faces the first switch pin 65. In the present preferred embodiment, the second switch pin 66 includes "one piston", which is one of the first piston and the second piston. The valve gear 1 according to the present preferred embodiment includes the first hydraulic supply 42 including the first arm half 81 of the second rocker arm 64, one end of the rocker shaft 37, the first rocker shaft support 34, the above-described first oil passage 94, and the like. The first hydraulic supply 42 corresponds to the "hydraulic supply that applies an oil pressure to one piston," and supplies an oil pressure to the second switch pin 66.

The second switch pin 66 has a length such that it is able to be housed in the second pin hole 91, as indicated by two-dot dashed lines in FIG. 9. The spring member 98 is provided between the inner bottom portion of the second switch pin 66 and the bottom portion of the second pin hole 91. The second switch pin 66 is pressed by the oil pressure applied via the first oil passage 94 and the spring force of the spring member 98 to press one end of the first switch pin 65 toward the other end in the stopper abutting state in which the first pin hole 73, the second pin hole 91, and the third pin hole 95 are located on the same axis.

The third switch pin 67 is movably fitted in the third pin hole 95. In this preferred embodiment, the third switch pin 67 and the above-described first switch pin 65 and second switch pin 66 define "switch pins." The third switch pin 67 includes a large-diameter portion 67*a* facing the first switch pin 65, and a small-diameter portion 67*b* projecting from the large-diameter portion 67*a* outside the second rocker arm 64. A step 99 is provided in the boundary between the large-diameter portion 67*a* and the small-diameter portion 67*b*.

The outer diameter of the small-diameter portion 67*b* is smaller than the inner diameter of the circlip 96 provided in the third pin hole 95. The distal end surface of the small-diameter portion 67*b* faces the above-described pressing plate 44*a* of the hydraulic piston 44.

The length of the third switch pin 67 in the axial direction is slightly shorter than the length of the third pin hole 95, as indicated by the two-dot dashed lines in FIG. 9. Thus, even if the hydraulic piston 44 advances until it hits the second arm half 82, the entire third switch pin 67 is housed in the second arm half 82, and two ends of the first switch pin 65 equally or substantially equally project from the first rocker arm 62.

In the stopper abutting state, if the hydraulic piston 44 is in the non-operation state, when the oil pressure in the first oil passage 94 rises, the first to third switch pins 65 to 67 are pressed to the side of the hydraulic piston 44 by the oil pressure and the spring force of the spring member 98, and move to connecting positions indicated by solid lines in FIG. 9. The non-operation state of the hydraulic piston 44 indicates a state in which no oil pressure is applied to the hydraulic piston 44. The connecting positions indicate positions where the movement of the third switch pin 67 is regulated when the step 99 abuts against the circlip 96. In this state, the first switch pin 65 is located across the first rocker arm 62 and the second arm half 82 of the second rocker arm 64. Furthermore, the second switch pin 66 is located across the first rocker arm 62 and the first arm half 81 of the second rocker arm 64. When the first to third switch pins 65 to 67 are located at the connecting positions, the first rocker arm 62 and the second rocker arm 64 are connected and able to integrally swing about the rocker shaft 37.

That is, the rotation of the cam 12 is converted into a reciprocating motion by the first rocker arm 62 and the second rocker arm 64, and the intake valves 8 or the exhaust valves 9 are driven. At this time, the third switch pin 67 is pressed against the circlip 96 and held at the connecting position. In addition, the third switch pin 67 moves along with the swing of the second rocker arm 64 in a state in which a clearance is defined with respect to the pressing plate 44*a* of the hydraulic piston 44. The pressing plate 44*a* is structured and arranged such that a portion of the pressing plate 44*a* always faces the third switch pin 67 even if the first and second rocker arms 62 and 64 swing.

As shown in FIG. 4, the hydraulic piston 44 retreats to a position where the first to third switch pins 65 to 67 are not prevented from moving to the connecting positions in the non-operation state. If the oil pressure in the second oil hole 45 rises while the oil pressure of the first oil passage 94 disappears, and the hydraulic piston 44 changes from the non-operation state to the operation state, the first to third switch pins 65 to 67 are pressed by the hydraulic piston 44 to move to the non-connecting positions indicated by the two-dot dashed lines in FIG. 9. At this time, the pressing plate 44*a* of the hydraulic piston 44 abuts against the second arm half 82. The third switch pin 67 is stored in the third pin hole 95. Two ends of the first switch pin 65 slightly project from the first rocker arm 62, and enter the concave portions 75 of the first and second arm halves 81 and 82. The second switch pin 66 is stored in the second pin hole 91.

When the first to third switch pins 65 to 67 are located at the non-connecting positions, the connected state between the first rocker arm 62 and the second rocker arm 64 is canceled. In this case, the first rocker arm 62 and the second rocker arm 64 are able to individually swing. Thus, as shown in FIG. 3, only the first rocker arm 62 is pressed by the cam 12 and swings, and the second rocker arm 64 never swings. In this case, since the intake valves 8 or the exhaust valves 9 are kept closed, the cylinders are in the rest state.

The outer diameters of the first to third switch pins 65 to 67 according to this preferred embodiment are set such that even if the first rocker arm 62 swings with respect to the second rocker arm 64, portions of the switch pins always face each other when viewed from the axial direction, as shown in FIG. 3.

Figure 13:
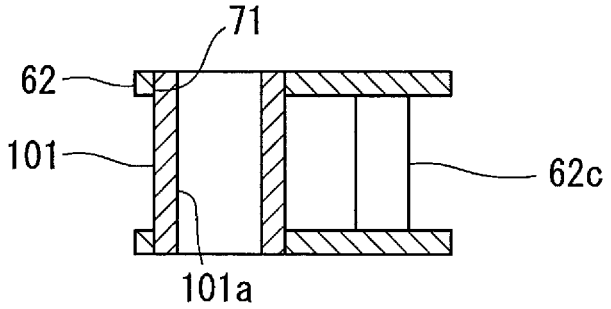
FIG. 13 is a sectional view for explaining the first step of a method of manufacturing the rocker arms.

A method of manufacturing the first rocker arm 62 and the second rocker arm 64 will be described next with reference to FIGS. 13 to 15. The manufacturing method is implemented by the first to fourth steps (to be described later). In the first step, as shown in FIG. 13, a cylindrical jig 101 is fitted in the shaft hole 71 of the first rocker arm 62, instead of the support shaft 72. The cylindrical jig 101 has an outer diameter which is fitted in the shaft hole 71 of the first rocker arm 62. The cylindrical jig 101 has an inner diameter which matches that of the second pin hole 91 and third pin hole 95 of the second rocker arm 64.

Figure 14:
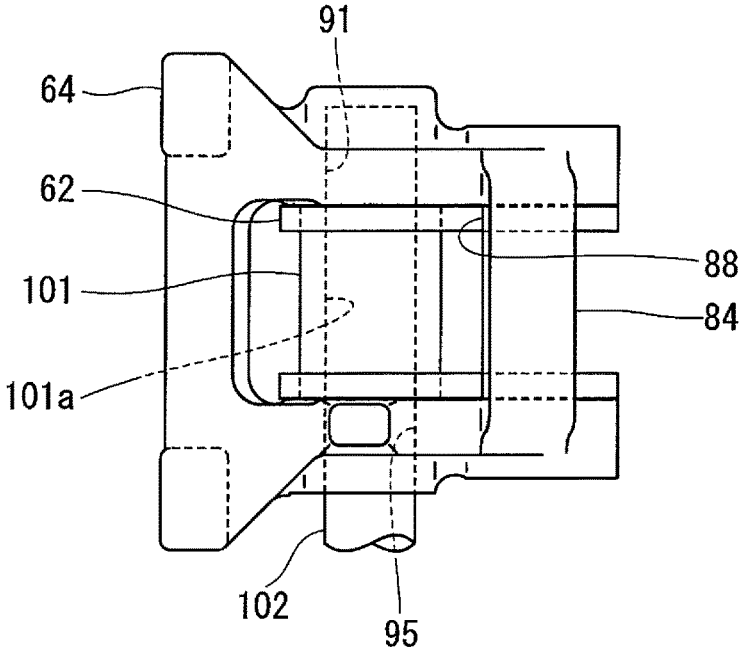
FIG. 14 is a sectional view for explaining the second and third steps of the method of manufacturing the rocker arms.

In the second step, as shown in FIG. 14, one rod-shaped jig 102 is fitted in the second and third pin holes 91 and 95 of the second rocker arm 64 and a hollow portion 101*a* of the cylindrical jig 101, instead of the first to third switch pins 65 to 67. The rod-shaped jig 102 preferably has a columnar shape having an outer diameter fitted in the hollow portion 101*a* (first pin hole 73) and the second and third pin holes 91 and 95. By implementing the second step, the first rocker arm 62 and the second rocker arm 64 are connected via the rod-shaped jigs 102.

In the third step, as shown in FIG. 14, the first rocker arm 62 is held in a state in which it abuts against the stopper 88 of the second rocker arm 64.

Figure 15:
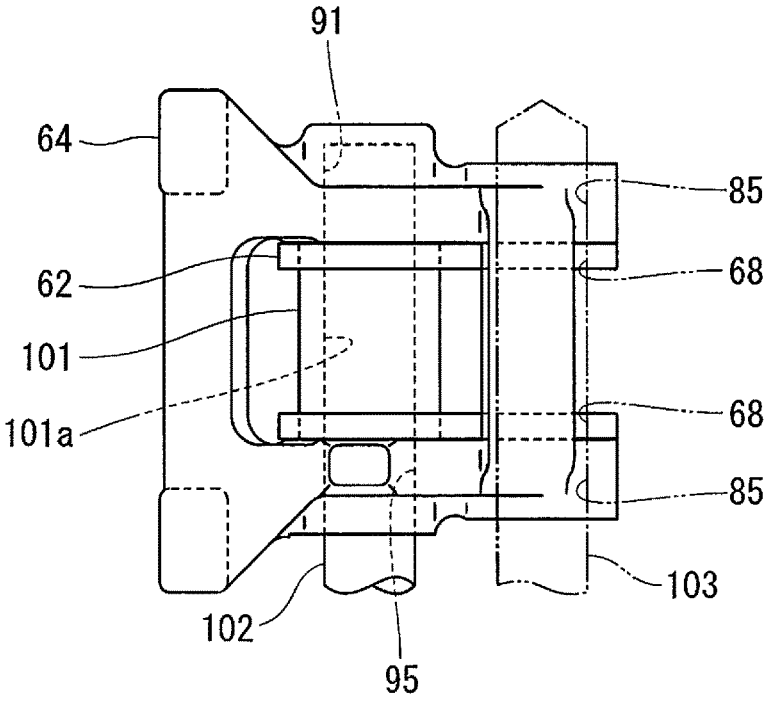
FIG. 15 is a sectional view for explaining the fourth step of the method of manufacturing the rocker arms.

In the fourth step, as shown in FIG. 15, the through holes 68 and 85 that allow the rocker shafts 37 through the first rocker arm 62 and the second rocker arm 64 are co-processed by drills 103. In other words, the drills 103 are passed through the held first rocker arm 62 and the second rocker arm 64, and holes (through holes 68 and 85) enabling the rocker shafts 37 to pass through are processed.

After forming the through holes 68 and 85 in this way, and pulling the rod-shaped jigs 102 out from the first and second rocker arms 62 and 64, the assembly operation of the rocker arms 7 is performed. This assembly operation is performed by a temporary assembly step of temporarily combining the first rocker arm 62 and the second rocker arm 64 and a connecting step of passing the rocker shafts 37 through the rocker arms 62 and 64.

In the temporary assembly step, an assembly is formed by combining the first rocker arm 62 to which the roller 61 and the first switch pin 65 are assembled, and the second rocker arm 64 to which the second and third switch pins 66 and 67 and the spring member 98 are assembled. At this time, the convex portion 74 of the first switch pin 65 is inserted from the opening 97 into the concave portion 75 of the second rocker arm 64.

In the connecting step, in a state in which the convex portion 74 is located in the concave portion 75, the rocker arms 7 are inserted between the first rocker shaft support 34 and the second rocker shaft support 35 of the rocker housing 31, and the rocker shafts 37 are passed through these members. If the first and second rocker arms 62 and 64 are supported by the rocker shaft 37, the first switch pin 65 cannot leave the concave portion 75, thus keeping the state in which the first rocker arm 62 and the second rocker arm 64 are combined. Consequently, the rocker arms 7 are able to be dealt with while being mounted on the rocker housings 31. The rocker arms 7 are assembled to the cylinder head 4 by mounting the rocker housings 31 on the support wall portion 32 of the cylinder head 4 by the fixing bolts 33.

In the valve gear 1 for the engine 2, which has the above arrangement, an oil pressure applied to the second switch pin 66 as one of the two hydraulic pistons (second switch pin 66 and hydraulic piston 44) is supplied through the first oil passage 94 including the interior of the rocker shaft 37. An oil pressure applied to the hydraulic piston 44 as the other piston is supplied through the second oil hole 45 (second oil passage) provided in the rocker housing.

The first oil passage 94 is defined by a path from the first arm half 81 of the second rocker arm 64 through one end of the rocker shaft 37 to the first rocker shaft support 34 of the rocker housing 31. Thus, the lubricating oil hole 51 (large-diameter portion 51*a*) is able to be provided in a portion except for one end of the rocker shaft 37.

Therefore, according to this preferred embodiment, the lubricating oil passage 54 is provided in the rocker shaft 37 without increasing the outer diameter of the rocker shaft 37 while adopting the arrangement of forming, in the rocker shaft 37, the oil passage 53 to supply an oil pressure.

In addition, since one hydraulic piston (second switch pin 66) is provided in the rocker arm 7, the rocker arm 7 preferably has a small weight and a compact size, as compared with the valve gear described in Japanese Patent Publication No. 8-6569, in which two hydraulic pistons are provided in the rocker arm 7. This increases the rotation speed of the engine 2, thus providing the valve gear for the engine capable of improving the output. In addition, according to this preferred embodiment, as compared with a case in which two hydraulic pistons are provided outside the rocker housing 31, one convex portion (the hydraulic operation portion 35*a* of the second rocker shaft support 35) projecting in the axial direction is needed to store the hydraulic pistons. Consequently, it is possible to obtain the valve gear which is compact in the axial direction of the rocker shaft 37.

The engine 2 according to this preferred embodiment preferably is a multi-cylinder engine. The rocker housing 31 and the rocker shaft 37 are provided for each cylinder. The rocker housing 31 is defined by the first rocker shaft support 34 which supports one end of the rocker shaft 37, the second rocker shaft support 35 which supports the other end of the rocker shaft 37, and the connector 36 which connects the first rocker shaft support 34 and the second rocker shaft support 35. A portion of the first oil passage 94 is located in the first rocker shaft support 34, and the second oil hole 45 defining and functioning as the second oil passage is located in the second rocker shaft support 35.

According to this preferred embodiment, a rocker arm assembly for each cylinder is provided by mounting the first and second rocker arms 62 and 64 on the rocker housing 31 via the rocker shaft 37.

Therefore, according to this preferred embodiment, it is possible to readily assemble, to the cylinder head 4, the valve gear 1 capable of switching between the structure in which the two types of rocker arms 62 and 64 are connected and the structure in which the rocker arms are separated. Especially, the valve gear 1 according to this preferred embodiment hardly imposes a restriction on the structure of the camshaft support 27 existing between the cylinders. Consequently, along with the compact valve gear 1, the degree of freedom of the layout of the respective constituent elements of the cylinder head 4 becomes high.

In the rocker shaft 37 according to this preferred embodiment, the two oil passages 53 and 54 which are adjacent to each other in the axial direction of the rocker shaft 37 across the partition 52 in the rocker shaft 37 are provided. Among these oil passages, one oil passage 53 is a portion of the first oil passage 94 which supplies an oil pressure to the second switch pin 66. The other oil passage 54 is a portion of a lubricating oil passage which supplies oil to the lubricated portions of the first rocker arm 62 and second rocker arm 64.

Thus, it is possible to sufficiently supply oil to the lubricated portions of the first rocker arm 62 and second rocker arm 64, thus reliably lubricating the lubricated portions. When lubricating the first and second rocker arms 62 and 64, the reliability becomes high.

The two oil passages 53 and 54 in the rocker shaft 37 according to this preferred embodiment are partitioned and defined by the one oil hole 51 located in the rocker shaft 37 and the plug 55 which closes the middle portion of the oil hole 51.

Therefore, the oil hole 51 is able to be made by drilling. The plug 55 is able to be press-fitted in the oil hole 51, and fixed. Thus, the two oil passages 53 and 54 are able to be readily provided in the rocker shaft 37. Especially, as compared with a case in which two oil holes are drilled in the rocker shaft 37 from two ends, and the opening of one of the oil holes is closed by the plug, the rocker shaft 37 is able to have a short length, thus providing a valve gear with a reduced weight and size.

Second Preferred Embodiment

Figure 16:
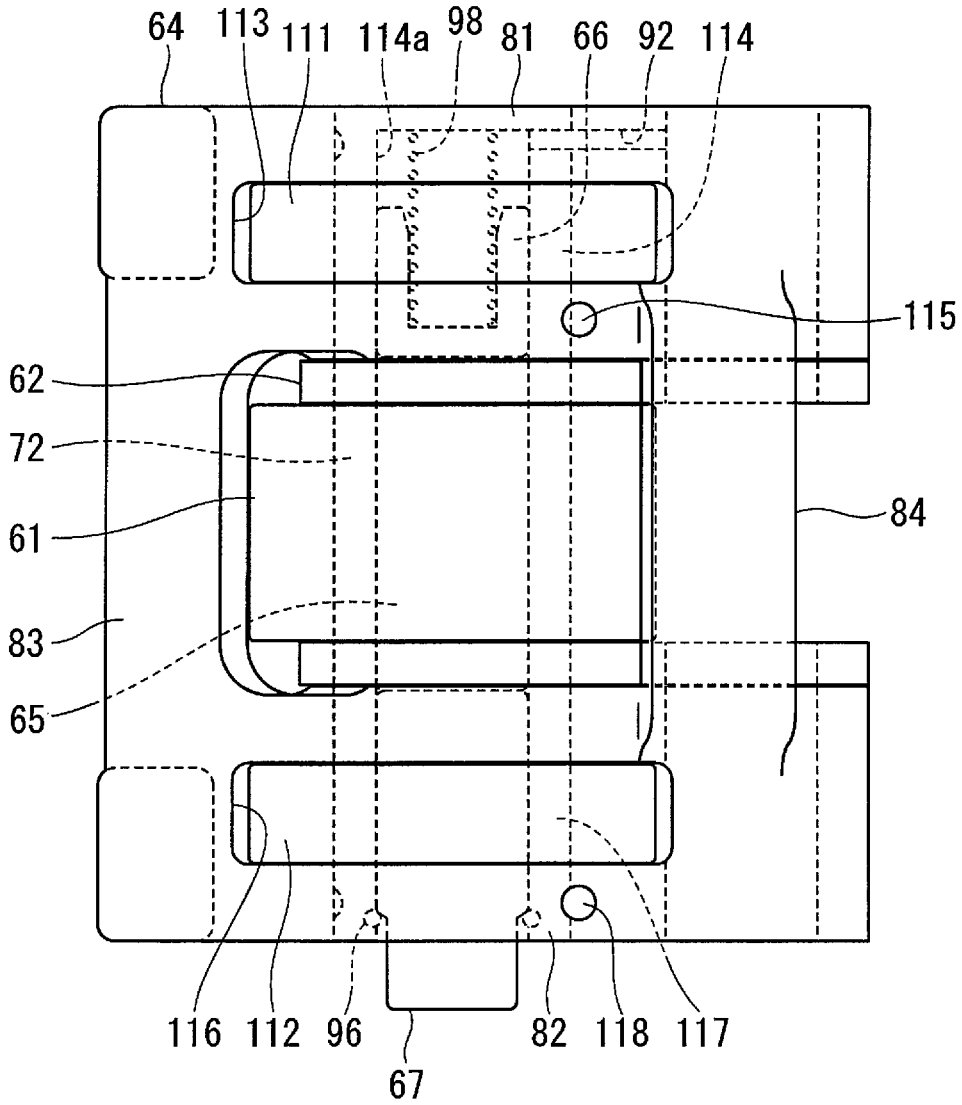
FIG. 16 is a plan view showing the first and second rocker arms according to a second preferred embodiment of the present invention.
Figure 17:
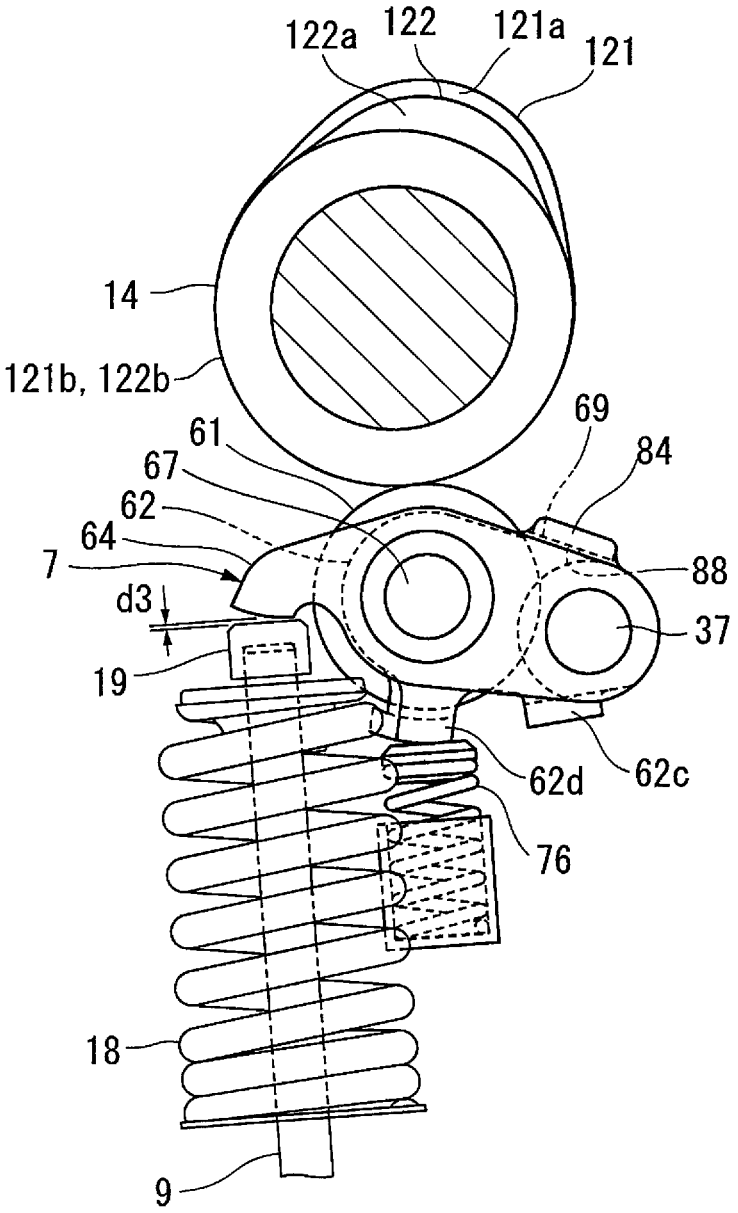
FIG. 17 is a side view showing the main portion of a valve gear according to the second preferred embodiment of the present invention.

A valve gear for an engine according to a second preferred embodiment of the present invention is shown in FIGS. 16 and 17. The same reference numerals as those of the elements described with reference to FIGS. 1 to 15 denote the same or similar elements in FIGS. 16 and 17, and a detailed description thereof will be omitted.

A second rocker arm 64 according to a second preferred embodiment of the present invention includes a first cam follower 111 and a second cam follower 112. Each of the cam followers 111 and 112 is preferably defined by a roller having the same or substantially the same diameter as that of a roller 61 of a first rocker arm 62.

The first cam follower 111 is inserted into a hole 113 in a first arm half 81, and is rotatably supported by a first tubular shaft 114 via a bearing (not shown). The first tubular shaft 114 has a closed-end cylindrical or substantially cylindrical shape, and is fixed to the first arm half 81 by a positioning pin 115 press-fitted in the first arm half 81. A hollow portion 114*a* of the first tubular shaft 114 defines a cylinder hole. While a second switch pin 66 defining a hydraulic piston is movably fitted in the hollow portion, a spring member 98 which biases the second switch pin 66 is housed in the hollow portion. Similarly to a case in which the preferred embodiment shown in FIG. 9 is used, the interior of the first tubular shaft 114 is connected to a fourth communication hole 93 (not shown) of the rocker shaft 37 by an oil hole 92 extending to a rocker shaft 37 through the first tubular shaft 114.

The second cam follower 112 is inserted into a hole 116 in a second arm half 82, and is rotatably supported by a second tubular shaft 117 via a bearing (not shown). The second tubular shaft 117 preferably has a cylindrical or substantially cylindrical shape that passes through the second arm half 82. The second tubular shaft 117 is fixed to the second arm half 82 by a positioning pin 118 press-fitted in the second arm half 82. While a third switch pin 67 is movably fitted in the inner circumferential portion of the second tubular shaft 117, a circlip 96 which regulates the movement of the third switch pin 67 is provided in the inner circumferential portion.

The first tubular shaft 114 and the second tubular shaft 117 are located on the same axis as a support shaft 72 of the first rocker arm 62 in a predetermined state. The predetermined state is a state in which the first rocker arm 62 and the second rocker arm 64 are supported by rocker shafts 37 and the first rocker arm 62 abuts against a stopper 88.

On the other hand, as shown in FIG. 17, a camshaft 14 according to the present preferred embodiment includes a first cam 121 which contacts the roller 61 of the first rocker arm 62, and two second cams 122 which respectively contact the first and second cam followers 111 and 112 of the second rocker arm 64. The first cam 121 includes a nose 121*a* and a circular or substantially circular base 121*b*. The second cam 122 includes a nose 122*a* and a circular base 122*b*. The projection amount of the nose 122*a* of the second cam 122 is smaller than that of the nose 121*a* of the first cam 121.

According to the present preferred embodiment, when the first rocker arm 62 and the second rocker arm 64 are connected and integrated, intake valves 8 or exhaust valves 9 are driven by the first cam 121. When the first rocker arm 62 and the second rocker arm 64 are separated, the intake valves 8 or the exhaust valves 9 are driven by the second cam 122.

Therefore, according to the present preferred embodiment, it is possible to provide a valve gear for an engine that is able to switch between the first driving operation in which the valve lift amount of the intake valves 8 or the exhaust valves 9 is large and the second driving operation in which the valve lift amount of the intake valves 8 or the exhaust valves 9 is small.

Third Preferred Embodiment

Figure 18:
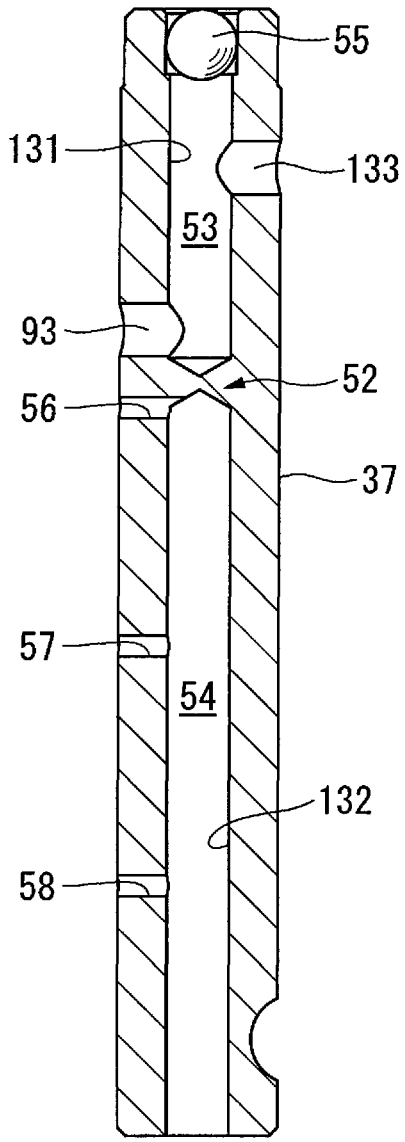
FIG. 18 is a sectional view showing a rocker shaft according to a third preferred embodiment of the present invention.

A rocker shaft may be provided as shown in FIG. 18. The same reference numerals as those of the elements described with reference to FIGS. 1 to 17 denote the same or similar elements in FIG. 18, and a detailed description thereof will appropriately be omitted.

Two oil passages 53 and 54 of a rocker shaft 37 shown in FIG. 18 include first and second oil holes 131 and 132, respectively. The first oil hole 131 of one oil passage 53 is, for example, drilled up to a partition 52 from one end of the rocker shaft 37 to the other end.

A fourth communication hole 93 and a fifth communication hole 133, which extend in the radial direction of the rocker shaft 37, are provided in the oil passage 53. The fifth communication hole 133 communicates the interior of the first oil hole 131 with the first oil hole 40. The opening of the first oil hole 131 is closed by a press-fitted plug 55.

The second oil hole 132 of the other oil passage 54 is, for example, drilled up to the partition 52 from the other end of the rocker shaft 37 to one end.

Even if the rocker shaft 37 is processed in this way, it is possible to obtain the same effect as in the above-described preferred embodiments.

The rocker housing 31 in each of the above-described first and second preferred embodiments is preferably obtained by integrally providing the first and second rocker shaft supports 34 and 35 and the connector 36. These three functional elements of the rocker housing 31 may be individually provided. In this case, the rocker housing 31 is provided by connecting the first rocker shaft support 34 and the second rocker shaft support 35 to the connector 36 by bolts, for example.

Each of the above-described preferred embodiments of the present invention has explained an example of a valve gear in which the third switch pin 67 is directly pressed by the hydraulic piston 44. However, a swinging lever may be provided between the hydraulic piston 44 and the third switch pin 67. This lever is swingably supported by the second rocker shaft support 35 of the rocker housing 31 in a state in which one swing end is in contact with the third switch pin 67 and the other end is in contact with the hydraulic piston. By using this arrangement, the degree of freedom of the installation position of the hydraulic piston is improved.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

The invention claimed is:

1. A valve gear for an engine comprising:

a plurality of camshaft supports in a cylinder head aligned in an axial direction of a crankshaft;

a camshaft rotatably supported by the plurality of camshaft supports, and including a cam that drives one of an intake valve and an exhaust valve;

a rocker housing separate from the cam shaft supports, and mounted on the cylinder head to be located between the plurality of camshaft supports;

a rocker shaft including first and second ends supported by the rocker housing;

a first rocker arm swingably supported by the rocker shaft;

a second rocker arm swingably supported by the rocker shaft and selectively connected to the first rocker arm by a switch pin movable in an axial direction of the rocker shaft;

a first piston that moves the switch pin to a first side in the axial direction;

a second piston that moves the switch pin to a second side in the axial direction; and hydraulic supplies that apply an oil pressure to the first piston and the second piston; wherein one of the first and second pistons is provided in one of the first and second rocker arms and the other one of the first and second pistons is provided in the rocker housing located on a side opposite to the one piston in the axial direction across the other of the first and second rocker arms;

the hydraulic supply that applies the oil pressure to the one piston includes a first oil passage in the one rocker arm, the rocker shaft, and the rocker housing that supports the first end of the rocker shaft; and the hydraulic supply that applies the oil pressure to the other piston includes a second oil passage in the rocker housing.

2. The valve gear for the engine according to claim 1, wherein the engine is a multi-cylinder engine;

the rocker housing and the rocker shaft are provided for each cylinder in the multi-cylinder engine;

the rocker housing includes;

a first rocker shaft support that supports the first end of the rocker shaft;

a second rocker shaft support that supports the second end of the rocker shaft; and a connector that connects the first rocker shaft support and the second rocker shaft support;

a portion of the first oil passage is located in the rocker shaft support of one of the first rocker shaft support and the second rocker shaft support; and the second oil passage is located in the other rocker shaft support.

3. The valve gear for the engine according to claim 1, wherein the rocker shaft includes two oil passages adjacent to each other in the axial direction of the rocker shaft across a partition in the rocker shaft;

one of the two oil passages defines a portion of the first oil passage; and the other of the two oil passages defines a lubricating oil passage that supplies oil to lubricate portions of the first rocker arm and the second rocker arm.

4. The valve gear for the engine according to claim 3, wherein the two oil passages in the rocker shaft are partitioned and include an oil hole in the rocker shaft and a plug that closes a middle portion of the oil hole.

* * * * *